United States Patent [19]

Pennartz

[11] Patent Number: 4,950,410

[45] Date of Patent: Aug. 21, 1990

[54] FIRE EXTINGUISHING COMPOSITIONS AND METHODS

[75] Inventor: Edmond R. J. Pennartz, N. Vancouver, Canada

[73] Assignee: United American, Inc., Custer, Wash.

[21] Appl. No.: 292,417

[22] Filed: Dec. 30, 1988

[51] Int. Cl.[5] ..... A62D 1/00; A62C 1/00; A62C 3/00

[52] U.S. Cl. ..... 252/7; 252/2; 252/4; 169/46

[58] Field of Search ..... 252/2, 4, 7, 601, 607; 169/46

[56] References Cited

U.S. PATENT DOCUMENTS

| | | | |
|---|---|---|---|
| 80,770 | 8/1868 | Glabraith | 252/2 |
| 431,985 | 7/1890 | Martin | 252/2 |
| 836,265 | 11/1906 | Mayer | 252/2 |
| 1,076,762 | 10/1913 | Hall | 252/2 |
| 1,451,485 | 4/1923 | Wootton | 252/2 |
| 1,716,476 | 6/1929 | Austin | 252/2 |
| 2,388,014 | 10/1945 | Sargent et al. | 252/2 |
| 2,768,952 | 10/1956 | Anthony, Jr. et al. | 252/7 |
| 3,095,372 | 6/1963 | Cope | 252/2 |
| 3,673,088 | 6/1972 | Clements | 252/2 |
| 3,719,515 | 3/1973 | Degginger | 252/2 |
| 4,133,823 | 1/1979 | Joyce, III et al. | 252/7 |
| 4,289,662 | 9/1981 | Blasius | 252/607 |
| 4,313,761 | 2/1982 | Joyce, III et al. | 252/7 |

*Primary Examiner*—Howard J. Locker

*Attorney, Agent, or Firm*—Hughes & Multer

[57] ABSTRACT

Fire extinguishing compositions which contain sodium chloride, magnesium chloride, sodium sulfate, calcium chloride, magnesium sulfate, and water. Optional constituents are calcium sulfate, potassium sulfate, magnesium bromide, and potassium chloride.

3 Claims, No Drawings

FIRE EXTINGUISHING COMPOSITIONS AND METHODS

FIELD OF THE INVENTION

The present invention relates to the putting out of unwanted fires and, more particularly, to novel, improved fire extinguishing compositions and to the use of those compositions to extinguish fires.

BACKGROUND OF THE INVENTION

Many fire extinguishing compositions have heretofore been proposed. Those believed by me to most closely resemble the compositions disclosed herein are described in U.S. Pat. No. 80,770 issued 4 Aug. 1868 to Galbraith for IMPROVED COMPOUND FOR EXTINGUISHING FIRES; U.S. Pat. No. 431,985 issued 8 July 1890 to Martin for FIRE-EXTINGUISHING COMPOUNDS; U.S. Pat. No. 836,265 issued 20 Nov. 1906 to Mayer for FIRE-EXTINGUISHING COMPOUND; U.S. Pat. No. 1,716,476 issued 11 June 1929 to Austin for FIRE-EXTINGUISHING LIQUID; U.S. Pat. No. 2,388,014 issued 30 Oct. 1945 to Sargent et al. for FIRE EXTINGUISHING COMPOSITION; and U.S. Pat. No. 2,768,952 issued 30 Oct. 1956 to Anthony, Jr. for COMPOSITION AND METHOD OF EXTINGUISHING LIGHT METAL FIRES; and in German Offenlegungsschrift No. DE 3634125 Al laid open to public inspection 21 Apr. 1988 and entitled Feuerlöschlösung zum Löschen von Phosphor- und Metallbraden. A similar fire extinguishing composition intended to be used in powder form is disclosed in U.S. Pat. No. 3,095,372 issued 25 June 1963 to Cope.

In each case, however, the previously disclosed fire extinguishing composition lacks one or more properties which applicant has found highly desirable in, if not essential to, a composition of the character in question. These, typically present drawbacks of the compositions disclosed in the above cited prior art are: inability of the composition to prevent reignition of the combustible material, once a fire has been extinguished; inability to reduce the temperature of the burning material at a rapid enough rate to allow a fire to be expeditiously extinguished; and an inability to penetrate common combustible materials to the extent necessary for a fire extinguishing composition to: (a) be effective and (b) absorb thermal energy from the burning material once it has been penetrated by the composition.

In addition, previously proposed fire extinguishing compositions of the same general character as those disclosed herein are apt to freeze, especially when sprayed at low temperatures. This significantly limits the utility of such compositions as they cannot be used during the winter months in the colder geographical regions and in other circumstances where sub-freezing temperatures prevail.

SUMMARY OF THE INVENTION

There have now been invented and disclosed herein certain new and novel fire extinguishing compositions which are free of the above-enumerated and other drawbacks possessed by previously proposed compositions of that character.

The essential ingredients of these novel formulations are: an aqueous carrier and sodium chloride (NaCl), magnesium chloride ($MgCl_2$), and hydrated sodium sulfate ($Na_2SO_4$. $10.H_2O$). Optional constituents that can be employed to advantage are: calcium sulfate ($CaSO_4$), potassium sulfate ($K_2SO_4$), magnesium bromide ($MgBr_2$), and potassium chloride (KCl).

One important advantage of these novel fire extinguishing formulations over others which contain common constituents is that the formulations disclosed herein are capable of keeping a fire from reigniting once it has initially been extinguished. This is of considerable importance as incalculable damage results each year from fires that have ostensibly been extinguished but reignite after fire fighting equipment and personnel have left the scene.

Yet another important advantage of the herein disclosed formulations is their ability to reduce the temperatures of burning materials at a much faster rate than is believed to be possible with previously proposed fire extinguishing compositions. Thus even many even difficult to extinguish fires can be put out fast enough with the herein disclosed formulations to significantly reduce the damage caused by the fire.

A further, and also very important, attribute of the present invention is the ability of the herein disclosed compsotions to penetrate into burning material and, after effecting penetration, to release water vapor (which absorbs significant amounts of thermal energy). This heat absorption capacity of an impregnated liquid also plays a significant role in the effectiveness of the disclosed formulations In addition, the novel fire-extinguishing compositions disclosed herein have fertilizer properties due to the inclusion therein of compounds such as magnesium chloride, magnesium bromide, potassium chloride, and potassium sulfate. This is a significant advantage in applications involving the fighting of forest, brush, and grassland fires as the herein disclosed compositions replenish nutrients destroyed by the heat of the fire.

Furthermore, the novel fire extinguishing compositions of the present invention are capable of flameproofing such materials commonly involved in unwanted fires as wood, paper, and cardboard. This feature contributes significantly to the versatility of the herein disclosed compositions and the ability of those compositions to serve as "universal" fire extinguishing mediums capable of extinguishing unwanted fires started in a wide variety of materials including such very difficult-to-extinguish materials as burning rubber and light metals (for example, magnesium).

And, yet another and extremely important advantage of the fire extinguishing compositions disclosed herein is that they contain only compounds with low levels of mammalian toxicity. Therefore, these novel compositions do not pose a significant health hazard to firefighters or other humans or animals that come into contact with the fire extinguishing composition or residues of that composition.

At the same time, because they employ only constituents such as sodium chloride that are available in quantity and at low cost, the fire extinguishing compositions of the present invention are inexpensive to produce.

Still another important advantage of the novel formulations disclosed herein is that the constituent employed to prevent freezing (calcium chloride) is also a highly effective agglomerant for airborne particles of soot (carbon). The agglomerated particles rapidly settle out of the atmosphere and are therefore not apt to be inhaled by persons in the vicinity of a fire. The significance of this removal of airborne carbon particles from the atmosphere can best be appreciated by remembering that the majority of fire-associated deaths and injuries are attributable to smoke inhalation and not to the fire itself.

The previously identified optional constituents can be employed to advantage to enhance above-described, desirable properties of the novel fire extinguishing compositions of the present invention. They may be used, for example, to: provide additional flameproofing, enhance the plant nutrient and soil improving properties of the formulation, increase the fire extinguishing ability of the composition by making it capable of releasing small, relatively harmless amounts of heavier halide (typically bromide) ions at elevated temperatures, and buffer the aqueous fire extinguishing composition to an optimal pH; i.e., to a pH in the range of 6.8 to 7.8. Formulations with a pH outside of the just-designated neutral range are preferably avoided because of the dangers they pose to those whom the formulations may contact.

OBJECTS OF THE INVENTION

From the foregoing, it will be apparent to the reader that one important and primary object of the present invention resides in the provision of novel, improved fire extinguishing compositions.

Other, also important but more specific objects reside in the provision of fire extinguishing compositions as described in the preceding object:

which are cost effective;

which have an acceptably low level of toxicity;

which exhibit superior performance;

which, in conjunction with the preceding objects, are capable of rapidly and efficiently extinguishing such difficult materials as burning rubber and metals;

which are versatile in that they can be used with equal facility to extinguish, as examples: fires of the character identified in the preceding object; range, brush and forest fires; and burning wood, paper and cardboard;

which are effective to prevent reignition of a fire which has ostensibly been extinguished;

which can be used at sub-ambient temperatures without danger of freezing;

which contain plant nutrient/soil improvers and therefore contribute to the rehabilitation of burned over soil in applications in which it is a fire in vegetation that is being fought;

which have significant flameproofing capabilities;

which are capable of agglomerating airborne soot (carbon) particles, thereby reducing injuries and deaths attributable to smoke inhalation.

Other important objects and features of the invention will be apparent to the reader from the foregoing, the appended claims, and the ensuing detailed description and discussion of the invention.

DETAILED DESCRIPTION OF THE INVENTION

As described above, the novel fire extinguishing compositions of the present invention have an aqueous carrier and the following, additional essential ingredients:

Sodium Chloride
Magnesium Chloride
Sodium Sulfate (preferably in the decahydrate form)
Calcium Chloride
Magnesium Sulfate.

Optional ingredients are:

Calcium Sulfate
Potassium Sulfate
Magnesium Bromide
Potassium Chloride.

The novel fire extinguishing compositions are formulated as follows:

| Constituent | Percent by Weight |
|---|---|
| Sodium Chloride | 24 to 70 |
| Magnesium Chloride | 7 to 40 |
| Sodium Sulfate Decahydrate | 3 to 26 |
| Calcium Chloride | 2 to 40 |
| Magnesium Sulfate | 2 to 20 |
| Calcium Sulfate | 0 to 45 |
| Potassium Sulfate | 0 to 29 |
| Magnesium Bromide | 0 to 26 |
| Potassium Chloride | 0 to 17 |
| Water | 58 to 87. |

One representative and presently preferred formulation is:

| Constituent | Percent by Weight |
|---|---|
| Sodium Chloride | 24 |
| Magnesium Chloride | 7 |
| Sodium Sulfate Decahydrate | 3 |
| Calcium Chloride | 2 |
| Magnesium Sulfate | 2 |
| Water | Balance |

Concentrations of the essential ingredients below the lower limits identified above are apt to result in compositions which are of greatly reduced effectiveness if active at all. Above the stated maximum concentrations, the essential and optional constituents at best increase the cost of the composition without any significant increase in effectiveness. In the worst cases, there is an antagonistic effort so that the compositions actually become less effective if the stated maximum amounts of constituents are exceeded.

The essential and optional constituents of the herein disclosed fire extinguishing compositions are employed for the following purposes:

Sodium Chloride

This constituent functions as a wetting agent in that it decreases the surface tension of the fire extinguishing composition, allowing the liquid phase of the atomized formulation to rapidly disperse over a large area. As a consequence, the formulation is capable of absorbing heat over an area which will typically extend well beyond that area in which the combustible material is actually burning, inhibiting the spread of the fire. At the same time, the active ingredients tend to remain in the locale in which the atomized liquid is applied, extinguishing the fire by rapidly reducing the temperature of the burning material and by severely inhibiting the ability of the combustible material to be ignited.

Furthermore, at elevated temperatures, halogen ($Cl^-$) ions are released from this constituent of the fire extinguishing composition. These ions combine with oxygen in the ambient surroundings. This promotes the effectiveness of the composition as the thus combined oxygen is not available to support the combustion process.

Furthermore, as the aqueous phase of the composition evaporates, a solid sodium chloride residue is formed on the surface of the combustible material. This residue tends to seal the pores in the surface of the combustible material. The consequence is that oxygen cannot penetrate beyond the surface of the combustible material, and reignition of the combustion material is thereby inhibited.

Magnesium Chloride

This constituent of the novel, herein disclosed fire extinguishing compositions markedly increases the ability of the formulation to penetrate beyond the surface of the combustible material. This correspondingly increases the types of fires which the subject compositions can effectively be used to combat, making them what are, in essence, "universal" fire extinguishing compositions.

Further, because of its magnesium ion ($Mg^{++}$) content, this constituent adds a flameproofing capability to the fire extinguishing compositions in which it is incorporated in those instances in which the combustible material is wood, cardboard, paper, or the like. This is important as the fire will not spread to thus flameproofed areas of the combustible material.

Also, magnesium is a well-known plant nutrient; and compounds of that metal are equally well-known soil improvers. Therefore, this constituent of the formulation counters, to a significant extent, the heat damage to the soil caused by range, brush, and forest fires.

Hydrated Sodium Sulfate

This constituent is typically supplied as the decahydrate, a compound with the formula $Na_2SO_4.10H_2O$.

The chemically bound water of the hydrated sodium sulfate is released only at temperatures at, or above, 100° C. Thus, this chemically bound water can be transported deeper into the fire without evaporation than can the aqueous phase of the fire extinguishing composition. This has the effect of making more efficient the endothermic, heat-absorbing reactions between the burning, combustible material and the water, increasing the efficacy of the fire extinguishing composition.

Furthermore, sodium sulfate decahydrate is capable of absorbing seven times as much thermal energy as its prior art counterparts. Thus, by employing this constituent, one can materially increase the thermal energy absorptability of the fire extinguishing compound without increasing the dissolved solids content of the composition.

Calcium Chloride

Appropriate amounts of calcium chloride (identified above) keep the fire extinguishing compositions of the present invention from freezing, even at temperatures which are well below 0° C. This is important in that the herein disclosed fire extinguishing compositions can consequently be employed essentially in all climatic zones and during all seasons of the year.

Another important advantage of incorporating calcium chloride in the fire extinguishing compositions of the present invention is that this compound has a demonstrable and significant ability to bind together the fine, airborne particles of soot or carbon which are generated by the combustion of organic materials. This ability of the novel fire extinguishing compositions disclosed herein to agglomerate airborne carbon particles is second only in importance to the fire extinguishing capacity of those compositions. In particular, as was pointed out above, the agglomerated soot particles quickly settle out of the ambient atmosphere, keeping them from being inhaled and causing injury or even death.

In this respect, actual testing has shown that as much as fifteen to twenty percent of the soot particles given off by burning material can be agglomerated and thereby eliminated as a health hazard by incorporating an appropriate amount (indicated above) of calcium chloride in the fire extinguishing compositions disclosed herein.

Magnesium Sulfate

This constituent of the novel fire extinguishing compositions disclosed herein has a significant flameproofing or fireproofing capability, especially in applications of the present invention involving the fighting of textile fires and fires involving other synthetics. This capability can be employed to advantage in keeping the fire from spreading, thereby minimizing the quantities of toxic gases given off by the combustible material.

Also, because of its magnesium content, this constituent makes a significant contribution to the rehabilitation of burned over soils.

Magnesium Bromide

This optional constituent of the herein disclosed fire extinguishing compositions complements the previously discussed sodium chloride constituents. In particular, both compositions release halide ions at elevated temperatues; and, as discussed above, those ions have fire combatting properties in that they combine with oxygen in the surrounding atmosphere and make that oxygen unavailable to the combustion process. The halide ($Cl^{31}$) ions of the sodium chloride are released at a temperature of approximately 170° C. whereas the corresponding ions ($Br^-$) of the magnesium bromide do not become available until a temperature of about 750° C. is reached. At this point, the supply of available chloride items will typically have been exhausted. Thus, as indicated above, the magnesium bromide supports or complements the action of the sodium chloride by continuing the supply of oxygen depleting halide ions beyond the point at which such ions are available from the essential, sodium chloride constituent of the composition.

It is to be noted, in conjunction with the foregoing, that the concentrations of bromide ions released from the magnesium bromide are well within TLV guidelines. In particular, the herein disclosed compositions make available a maximum of three ppm/$m^3$ of bromide ion whereas the TLV guidelines permit a maximum of 5 ppm/$m^3$.

Potassium Sulfate

This optional ingredient is employed primarily in applications of the present invention which involve the combatting of forest, brush, and grass fires. Potassium is a well-known and essential plant nutrient, and the potassium sulfate employed in the herein disclosed compositions replaces soil borne potassium made unavailable by a fire. An optimal concentration of this constituent will typically be about 0.29 weight percent.

Potassium Chloride

This optional constituent is employed, as necessary, to buffer or raise the total pH of a fire extinguishing composition as disclosed herein to approximately 6.8–7.8.

It is important that the pH of the composition be in this range for the reasons discussed above.

The novel compositions of the present invention are employed in the forms of fogs and sprays. One particularly effective form of nozzle for developing the spray or fog has a central orifice surrounded by an array of secondary orifices. This nozzle is especially effective as it can be employed to direct a primary stream of atomized liquid onto the burning material and simultaneously envelop the flame in a curtain or shroud of the atomized fire extinguishing composition.

As was pointed out above, one important advantage of the present invention is that the novel fire extinguishing compositions disclosed herein have low levels of toxicity. Toxicity data on the essential and optional constituents of these compositions follows:

Sodium Chloride (NaCl)
CAS RN: 7647145
NIOSH #: VZ 4725000
Toxicity Data: 2

| | | |
|---|---|---|
| $LD_{50}$ | orl - rat | 3000 mg/kg |
| $LD_{50}$ | scu - rat | 3500 mg/kg |
| $LD_{50}$ | orl - mus | 4000 mg/kg |
| $LD_{50}$ | ipr - mus | 2602 mg/kg |
| $LD_{50}$ | scu - mus | 3150 mg/kg |
| $LD_{50}$ | ivn - mus | 645 mg/kg |
| $LD_{50}$ | ipr - dog | 364 mg/kg |
| | skn - rbt | 50 mg/24 H = MLD |
| | skn - rbt | 500 mg/24 H = MLD |
| | eye - rbt | 100 mg = MLD |
| | eye - rbt | 100 mg/24 H = SEV |

Ingestion of large amounts of sodium chloride can cause irritation of the stomach.

Magnesium Chloride ($MgCl_2$)
CAS RN: 7786303
NIOSH #: 2800000
Toxicity Data: 3-2

| | | |
|---|---|---|
| $LD_{50}$ | orl - rat | 2800 mg/kg |
| $LD_{50}$ | ipr - mus | 99 mg/kg |
| $LD_{50}$ | ivn - mus | 14 mg/kg |

Toxicologie Review: 27 ZTAP 3.88.69
Reported in EPA TSCA Inventory, 1980

Calcium Chloride ($CaCl_2$)
CAS RN: 10043524
NIOSH #: EV 9800000
Toxicity Data: 3-2

| | | |
|---|---|---|
| $LD_{50}$ | orl - rat | 1000 mg/kg |
| $LD_{50}$ | ims - rat | 25 mg/kg |
| $LD_{50}$ | ipr - mus | 280 mg/kg |
| $LD_{50}$ | ivn - mus | 42 mg/kg |

Reported in EPA TSCA Inventory 1980

Sodium Sulfate ($Na_2SO_4$)
CAS RN: 7767826
NIOSH #: WE 1650000
Toxicity Data: 2-1

| | | |
|---|---|---|
| $LD_{50}$ | orl - mus | 5989 mg/kg |
| LDLo | ivm - mus | 1220 mg/kg |
| LDLo | ivn - rbt | 4470 mg/kg |

Reported in EPA TSCA Inventory 1980
THR: MOD ivn, LOW orl,ivn

Magnesium Sulfate ($MgSO_4$)+Magnesium Bromide ($MgBr_2$)
CAS RN: 7847889
NIOSH #: OM 4500000
Toxicity Data: 2-1

| | | |
|---|---|---|
| $LD_{50}$ | scu - mus | 980 mg/kg |

Reported in EPA TSCA Inventory 1980
THR MOD scu,ipr,ivn,orl; LOW orl

Calcium Sulfate ($CaSO_4$)
Unknown

Potassium Sulfate ($K_2SO_4$)
CAS RN: 7778805
NIOSH #: TT5900000
Toxicity Data: 2

| | | |
|---|---|---|
| LDLo | orl - wmn | 800 mg/kg |
| LDLo | scu - gpg | 3000 mg/kg |

Reported in RPA TSCA Inventory 1980
THR: (WMN) MOD scu.
Swallowing large doses causes severe irritation.

Potassium Chloride (KCl)
CAS RN: 7447407
NIOSH #: TS 8050000
Toxicity Data: 3-2

| | | |
|---|---|---|
| $LD_{50}$ | ipr - rat | 660 mg/kg |
| $LD_{50}$ | ivn - rat | 39 mg/kg |
| $LD_{50}$ | orl - mus | 383 mg/kg |
| $LD_{50}$ | orl - gpg | 2500 mg/kg |

Toxicologie Review: INTEAG 15(1),7.47, 27ATAP 3,118,69
Reported in EPA TSCA Inventory 1980
THR: An eye irritant. Large oral doses cause gastrointestinal irritation, purging, weakness, and circulatory problems. Also, potassium chloride affects the blood picture.

The invention may be embodied in forms other than those disclosed above without departing from the spirit or essential characteristics of the invention. The present embodiments are therefore to be considered in all respects as illustrative and not restrictive, the scope of the invention being indicated by the appended claims rather than by the foregoing description; and all changes which come within the meaning and range of equivalency of the claims are therefore intended to be embraced therein.

What is claimed is:

1. A fire extinguishing composition formulated as follows:

| Constituent | Percent by Weight |
|---|---|
| Sodium Chloride | 24 to 70 |
| Magnesium Chloride | 7 to 40 |
| Sodium Sulfate Decahydrate | 3 to 26 |
| Calcium Chloride | 2 to 40 |
| Magnesium Sulfate | 2 to 20 |
| Calcium Sulfate | 0 to 45 |
| Potassium Sulfate | 0 to 29 |
| Magnesium Bromide | 0 to 26 |
| Potassium Chloride | 0 to 17 |
| Water | 58 to 87. |

2. A fire extinguishing composition as defined in claim 1 which has a pH range of 6.8 to 7.8.

3. A method of extinguishing a fire which comprises the step of applying to burning material a fire extinguishing composition as defined in claim 1 or in claim 2.

* * * * *